US011257355B2

(12) United States Patent
Hutz et al.

(10) Patent No.: US 11,257,355 B2
(45) **Date of Patent: *Feb. 22, 2022**

(54) SYSTEM AND METHOD FOR PREVENTING FALSE ALARMS DUE TO DISPLAY IMAGES

(71) Applicant: Alarm.com Incorporated, Tysons, VA (US)

(72) Inventors: David James Hutz, Herndon, VA (US); Donald Madden, Columbia, MD (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/001,991

(22) Filed: Aug. 25, 2020

(65) Prior Publication Data

US 2020/0388149 A1 Dec. 10, 2020

Related U.S. Application Data

(63) Continuation of application No. 16/293,576, filed on Mar. 5, 2019, now Pat. No. 10,789,832.

(Continued)

(51) Int. Cl.
*G08B 29/18* (2006.01)
*G08B 13/196* (2006.01)

(52) U.S. Cl.
CPC ..... *G08B 29/185* (2013.01); *G08B 13/196* (2013.01); *G08B 13/19652* (2013.01); *G08B 13/19615* (2013.01)

(58) Field of Classification Search
CPC ..... G08B 29/185; G08B 13/196; G08B 13/19615; G08B 13/19652
See application file for complete search history.

(56) References Cited

U.S. PATENT DOCUMENTS

2016/0364966 A1* 12/2016 Dixon ..... G08B 13/19606
2017/0255833 A1* 9/2017 Guerzoni ..... H04N 7/183
2018/0330169 A1* 11/2018 van Hoof ..... G08B 13/19613

FOREIGN PATENT DOCUMENTS

WO WO2016046780 3/2016

OTHER PUBLICATIONS

PCT International Search Report and Written Opinion in International Application No. PCT/US2019/020840, dated May 31, 2019, 14 pages.

(Continued)

*Primary Examiner* — Tsion B Owens
(74) *Attorney, Agent, or Firm* — Fish & Richardson P.C.

(57) ABSTRACT

Methods, systems, and apparatus, including computer programs encoded on a storage device, for preventing false alarms due to display images. In one aspect, a monitoring system is disclosed that includes a processor and a computer storage media storing instructions that, when executed by the processor, cause the processor to perform operations. The operations can include obtaining, by the monitoring system, image data that depicts a portion of a property, determining, by the monitoring system, that the image data depicts an object, based on determining, by the monitoring system, that the image data depicts an object, determining, by the monitoring system, whether the depicted object is located within an exclusionary region of the property, and based on determining, by the monitoring system, that the depicted object is not located within an exclusionary region of the property, triggering, by the monitoring system, an event based on the image data.

20 Claims, 5 Drawing Sheets

Related U.S. Application Data

(60) Provisional application No. 62/638,924, filed on Mar. 5, 2018.

(56) References Cited

OTHER PUBLICATIONS

PCT International Preliminary Report on Patentability in International Application No. PCT/US2019/020840, dated Sep. 17, 2020, 9 pages.

* cited by examiner

SYSTEM AND METHOD FOR PREVENTING FALSE ALARMS DUE TO DISPLAY IMAGES

CROSS-REFERENCE TO RELATED APPLICATIONS

This application is a continuation of U.S. application Ser. No. 16/293,576, filed Mar. 5, 2019, which claims the benefit of U.S. Provisional Patent Application No. 62/638,924 filed Mar. 5, 2018 and entitled "SYSTEM AND METHOD FOR PREVENTING FALSE ALARMS DUE TO DISPLAY IMAGES," and each application is hereby incorporated by reference in its entirety.

BACKGROUND

False alarms can be triggered whenever a component of a monitoring system detects data that appears to indicate that a potential event is occurring. Such false alarms can trigger false notifications to a user device of a resident of the property. Alternatively, or in addition, such false alarms may also trigger the dispatching of law enforcement authorities to investigate a property where no event is taking place. This can lead to a waste of resources.

SUMMARY

The present disclosure is directed towards a system, method, and computer program, embodied on a computer-readable medium, for preventing false alarms due to display images. Display images may include, for example, images displayed by a television, projector, hologram, picture, poster, or the like that depict objects such as one or more human persons. The present disclosure provides for the generation of exclusionary regions where display images exist in a property. A monitoring unit can then ignore one or more portions of captured images that are determined to be associated with an exclusionary region.

According to one innovative aspect of the present disclosure, monitoring system for preventing false alarms due to display images is disclosed. In one aspect, the monitoring system can include one or more storage devices, the one or more storage devices storing instructions that, when executed by the one or more processors, cause the one or more processors to perform operations. In some implementations, the operations may include obtaining, by the monitoring system, image data that depicts a portion of a property, determining, by the monitoring system, that the image data depicts an object, based on determining, by the monitoring system, that the image data depicts an object, determining, by the monitoring system, whether the depicted object is located within an exclusionary region of the property, and based on determining, by the monitoring system, that the depicted object is not located within an exclusionary region of the property, triggering, by the monitoring system, an event based on the image data.

Other aspects include corresponding methods, apparatus, and computer programs to perform actions of methods defined by instructions encoded on computer storage devices.

These and other versions may optionally include one or more of the following features. For instance, in some implementations, the exclusionary region is a portion of the property for which image data depicting an object is to be ignored by the monitoring system.

In some implementations, data identifying the exclusionary region was generated by the monitoring system based on an identification, by the monitoring system, that a portion of a different image data depicts a picture of an object on a wall, a display of a television, or a window.

In some implementations, boundaries of the exclusionary region are determined, by the monitoring system, based on a transition of first visual characteristics of portions of a wall that surround each respective side of the picture of the object on the wall, the display of the television, or the window to second visual characteristics of respective edges of the picture of the object on the wall, the display of the television, or the window.

In some implementations, the operations may further include obtaining, by the monitoring system, different image data that depicts a portion of the property, determining, by the monitoring system, that the different image data depicts an object, based on determining, by the monitoring system, that the different image data depicts an object, determining, by the monitoring system, whether an entirety of the depicted object is located within an exclusionary region of the property, and based on determining, by the monitoring system, that an entirety of the depicted object is located within an exclusionary region of the property, ignoring, by the monitoring system, the different image data, wherein ignoring the different image data includes a determination, by the monitoring system, to not trigger an event based on the different image data.

In some implementations, the operations may further include obtaining, by the monitoring system, different image data that depicts a portion of the property, determining, by the monitoring system, that the different image data depicts an object, based on determining, by the monitoring system, that the different image data depicts an object, determining, by the monitoring system, whether the depicted object is located within an exclusionary region of the property, and based on determining, by the monitoring system, that a portion the depicted object is located within an exclusionary region of the property and a portion of the depicted object is located outside of the exclusionary region, triggering, by the monitoring system, an event based on the different image data.

In some implementations, the operations may further include obtaining, by the monitoring system, different image data that depicts a portion of the property, and based on determining, by the monitoring system, that an object is not depicted by the different image data, ignoring, by the monitoring system, the second image data, wherein ignoring the different image data includes a determination, by the monitoring system, to not trigger an event based on the different image data.

In some implementations, determining, by the monitoring system, that the image data depicts an object may include obtaining, by the monitoring system, different image data that represents multiple different images that were captured before an image represented by the image data or after the image represented by the image data, and determining, by the monitoring system, whether the object moves into the exclusionary region or whether the object moves out of the exclusionary region based on the different image data.

In some implementations, the image data may include still image data or video image data.

In some implementations, the monitoring system may include a camera, a monitoring system control unit, or a monitoring application server.

In some implementations, the monitoring system may include a camera, monitoring system control unit, and a monitoring application server.

In some implementations, the object includes a human, a human with a package, a non-human animal, or a vehicle.

In some implementations, the event includes an alarm event, powering on of one or more connected lightbulbs located at the property, or recording sounds at the property using one or more microphones located at the property.

In some implementations, the portion of the property is an indoor portion of the property or an outdoor portion of the property.

According to one innovative aspect of the present disclosure, a monitoring system for preventing false alarms due to display images is disclosed. In one aspect, the monitoring system can include one or more storage devices, the one or more storage devices storing instructions that, when executed by the one or more processors, cause the one or more processors to perform operations. In some implementations, the operations may include obtaining, by the monitoring system, image data that depicts a portion of a property, determining, by the monitoring system, whether the image data of the portion of the property includes an exclusionary region, based on determining, by the monitoring system, that the image data of the portion of the property includes an exclusionary region, determining, by the monitoring system, whether the image data depicts an object within the exclusionary region, and based on determining, by the monitoring system, that the image data depicts an object that is not located within the exclusionary region, triggering, by the monitoring system, an event based on the image data.

Other aspects include corresponding methods, apparatus, and computer programs to perform actions of methods defined by instructions encoded on computer storage devices.

These and other versions may optionally include any of other features described above, one or more of the following features, or a combination thereof. For instance, in some implementations, the monitoring system can determine, that the image data depicts an object that is located within the exclusionary region. In such implementations, the operations may also include obtaining, by the monitoring system, different image data that depicts a portion of a property, determining, by the monitoring system, whether the different image data of the portion of the property includes an exclusionary region, based on determining, by the monitoring system, that the different image data of the portion of the property includes an exclusionary region, determining, by the monitoring system, whether the different image data depicts an object within the exclusionary region, and based on determining, by the monitoring system, that the different image data depicts an object that is located within the exclusionary region, ignoring, by the monitoring system, the different image data, wherein ignoring the different image data includes a determination, by the monitoring system, to not trigger an event based on the different image data.

According to another innovative aspect of the present disclosure, a monitoring system is disclosed for detecting an exclusionary region is disclosed. In one aspect, the monitoring system can include one or more storage devices, the one or more storage devices storing instructions that, when executed by the one or more processors, cause the one or more processors to perform operations. In some implementations, the operations may include for example obtaining, by the monitoring system, image data that depicts a portion of a property, detecting, by the monitoring system, that the image data includes a portion of the property that should be excluded from camera surveillance, generating, by the monitoring system, data that establishes an exclusionary region for the portion of the property that should be excluded from camera surveillance, and storing, by the monitoring system, the generated data in a memory device of a component of the monitoring system.

Other aspects include corresponding methods, apparatus, and computer programs to perform actions of methods defined by instructions encoded on computer storage devices.

These and other features of the present disclosure are further described below in the corresponding detail description, the claims, and the accompanying drawings.

DETAILED DESCRIPTION

Figure 1:
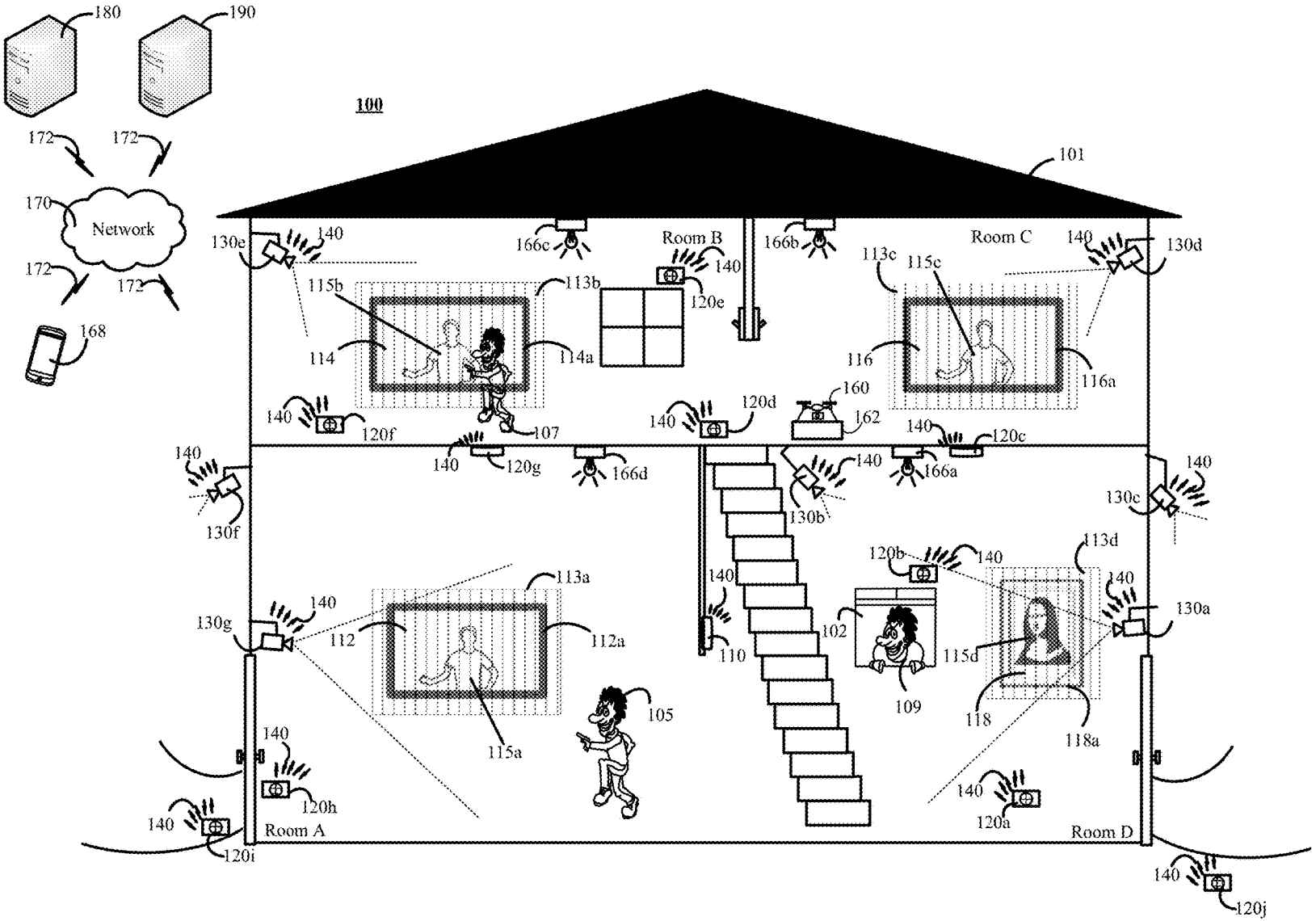
FIG. 1 is a contextual diagram of a monitoring system for preventing false alarms due to display images.

FIG. 1 is a contextual diagram of a monitoring system 100 for preventing false alarms due to display images. The monitoring system 100 includes at least a monitoring system control unit 110, one or more cameras 130*a*, 130*b*, 130*c*, 130*d*, 130*e*, 130*f*, 130*g* (hereinafter "130*a-g*"), and a network 140. The network 140 may include a LAN, a WAN, a cellular network, a Z-wave network, a ZigBee network, a Bluetooth network, a HomePlug network, the Internet, or a combination thereof. The network 140 may include wired components, wireless components, or a combination thereof. For example, the network 140 may include a fiber optic network, an Ethernet network, a Wi-Fi network, or a combination thereof.

In some implementations, the monitoring system 100 may also include one or more sensors 120*a*, 120*b*, 120*c*, 120*d*, 120*e*, 120*f*, 120*g*, 120*h*, 120*i*, 120*j* (hereinafter "120*a-j*"), one or more drones 160, one or more charging stations 162, one or more connected light bulbs 166*a*, 166*b*, 166*c*, 166*d* (hereinafter "166*a-d*"), a user device 168, a remote network 170, one or more communication links 172, a monitoring application server 180, a central alarm station server 190, or a combination thereof. The monitoring application server 180 can be configured to perform all of the operations described herein with respect to the monitoring system control unit 110. Accordingly, the monitoring application server 180 can be used as a cloud-based implementation of the monitoring system control unit 110. In such implementations, sensor data generated by one or more sensors 120*a-j*, image data generated by one or more cameras 130*a-g*, drone sensor data or drone image data generated by the drone 160, or any other type of data generated by the monitoring system 100 at the property 101 may be communicated to the monitoring application server 180 for analysis via the network 140, the network 170, one or more communication links 172, or a combination thereof. Image data may include, for example, data representing one or more features of a still image or one or more features of a video image.

The monitoring application server 180 may then communicate with one or more of the central alarm station server 190 or one or more other components of the monitoring system 100 at the property 101 using the network 170, one or more communication links 172, the network 140, or a combination thereof regarding the results of the monitoring application server's 180 analysis. For example, the monitoring application server 180 may transmit one or more instructions that trigger an alarm at the property 101, transmit a notification to the central alarm station server 190, transmit notifications to the user device 168, or a combination thereof—each of which may be based on based on the analysis of sensor data, image data, or the like from one or more monitoring system 100 components located at the property 101.

The monitoring system control unit 110 (or monitoring application server 180 or camera such as cameras 130*a*, 130*b*, 130*c*, 130*d*, 130*e*, 130*f*, 130*g*) is configured to obtain image data generated by one or more cameras 130*a-g* and determine whether the image data depicts a human object. If a human object is detected in the image data, then the monitoring system control unit 110 (or monitoring application server 180 or camera such as cameras 130*a*, 130*b*, 130*c*, 130*d*, 130*e*, 130*f*, 130*g*) is configured to determine whether an alarm should be triggered based on the image depicting a human object. A determination of whether an alarm should be triggered based on an image depicting a human object requires the monitoring system control unit 110 (or monitoring application server 180 or camera such as cameras 130*a*, 130*b*, 130*c*, 130*d*, 130*e*, 130*f*, 130*g*) to determine (i) whether the human object that is depicted by one or more images actually depicts a human person that is physically present in the property 101 or (ii) whether the human object depicted by the one or more images merely depicts an image of a human person displayed on a television, a projection screen (or wall), a hologram, a picture, a poster or the like.

If a depicted human object is determined to be a human that is physically present in the property 101, the monitoring system control unit 110 (or monitoring application server 180 or camera such as cameras 130*a*, 130*b*, 130*c*, 130*d*, 130*e*, 130*f*, 130*g*) can be configured to trigger an alarm at the property 101, transmit a notification to the central station server 190 indicating the detection of a potential event at the property 101, transmit a notification to the user device 168 indicating the detection of a potential event at the property 101, or a combination thereof. Alternatively, if a depicted human object is determined to merely be an image of a human person that is displayed on a television, a projection screen (or wall), a hologram, a picture, a poster or the like then the monitoring system control unit 110 (or monitoring application server 180 or camera such as cameras 130*a*, 130*b*, 130*c*, 130*d*, 130*e*, 130*f*, 130*g*) can determine to not trigger an alarm, not transmit a notification to a central alarm station server, not transmit a notification to a user device 168, or all of these. Because the monitoring system control unit 110 (or monitoring application server 180 or camera such as cameras 130*a*, 130*b*, 130*c*, 130*d*, 130*e*, 130*f*, 130*g*) can analyze images to distinguish between human persons that are physically present in the property 101 and display images of human persons that are not physically present in the property 101, the monitoring system control unit 110 (or monitoring application server 180 or camera such as cameras 130*a*, 130*b*, 130*c*, 130*d*, 130*e*, 130*f*, 130*g*) can avoid triggering false alarms based on mere images of a human person displayed on a television, a projection screen (or wall), a hologram, a picture, a poster or the like.

The monitoring system control unit 110 (or monitoring application server 180 or camera such as cameras 130*a*, 130*b*, 130*c*, 130*d*, 130*e*, 130*f*, 130*g*) can use exclusionary regions 113*a*, 113*b*, 113*c*, 113*d* (hereinafter "113*a-d*") to determine (i) whether an image that depicts a human object depicts a person that is physically present in the property 101 or (ii) whether an image that depicts a human object merely depicts a display of a human person that is not physically present in the property 101. The exclusionary regions 113*a-d* include portions of the property 101 for which image data should be ignored. Ignoring image data that is associated with an exclusionary region 113*a*-113*d* may include, for example, disregarding any image data depicting a human object that falls completely within the exclusionary region 113*a-d*. Accordingly, the monitoring system control unit 110 (or monitoring application server 180 or camera such as cameras 130*a*, 130*b*, 130*c*, 130*d*, 130*e*, 130*f*, 130*g*) is configured to not trigger an alarm, not transmit a notification to the central alarm station server 190, or not transmit a notification to the user device 168 if obtained image data depicts a human object that is completely located within an exclusionary region 113*a-d*.

The foregoing description generally describes the operations of the present disclosure as being performed by a monitoring system control 110. The foregoing description also indicates that the operations being performed by the monitoring system control unit 110 may also be performed by the monitoring application server 180 or a camera such as one of cameras 130*a*, 130*b*, 130*c*, 130*d*, 130*e*, 130*f*, 130*g*. In such alternative implementations, the monitoring application server 180 or one of the cameras 130*a*, 130*b*, 130*c*, 130*d*, 130*e*, 130*f*, 130*g* may perform all of the operations described with respect to the monitoring system control unit 110 without assistance from the monitoring system control unit 110. Alternatively, in other implementations, the application server 180 or a camera 130*a*, 130*b*, 130*c*, 130*d*, 130*e*, 130*f*, 130*g* may work together with the monitoring system control unit 110 to perform the operations described here. For example, a camera 130 may obtain and analyze one or more images, and if the camera 130 determines that the one or more images depicts a human outside of one or more exclusionary regions, the camera 130 can broadcast data such as a notification a monitoring system control unit 110 (or monitoring application server 180) that, when processed by the monitoring system control unit 110 (or monitoring application server 180), causes the monitoring system control unit 110 to trigger an alarm event.

Though an example of an event that may be triggered, or not triggered, using the systems and methods described herein include an alarm event. The present disclosure is not so limited. Instead, other types of events may be triggered, or not triggered. Such other types of events may include powering on of one or more light bulbs at the property, recording audio sounds at the property using one or more microphones, recording and storing image data using one or more cameras at the property, or any combination thereof.

Additionally, the foregoing description, and the description below, describes features of the present disclosure as analyzing images to detect whether a human object is depicted in image data. However, the present disclosure need not be so limited. Instead, the systems and methods of the present disclosure also work on other types of objects includes humans carrying packages, non-human animals such as dogs, cats, or other pets, vehicles, or any other types of objects.

With reference to Room A of FIG. 1, a camera 130*g* may generate image data of one or more portions of Room A during surveillance and monitoring of Room A. Surveillance and monitoring of Room A may include the camera 130*g* continuously capturing or periodically capturing image data of one or more portions of Room A. For example, in some implementations, the camera 130*g* may continuously capture image data of Room A while the monitoring system 100 is in an "armed" state (e.g., armed-away). In other implementations, the camera 130*g* may periodically capture images of Room A in response to the expiration of a predetermined time period, in response to motion detected by a motion sensor 120*h*, in response to a user command from the user device 168, or the like. The image data may include still image data, video image data, or a combination thereof.

The monitoring system control unit 110 (or monitoring application server 180 or camera such as cameras 130*a*, 130*b*, 130*c*, 130*d*, 130*e*, 130*f*, 130*g*) may obtain the image data generated by the camera 130*g* via one or more networks such as the networks 140, 170, one or more communications links 172, or a combination thereof. The monitoring system control unit 110 (or monitoring application server 180 or camera such as cameras 130*a*, 130*b*, 130*c*, 130*d*, 130*e*, 130*f*, 130*g*) may analyze the obtained image data to determine whether the image data depicts one or more human objects. With reference to the example of Room A, the monitoring system control unit 110 (or monitoring application server 180 or camera such as cameras 130*a*, 130*b*, 130*c*, 130*d*, 130*e*, 130*f*, 130*g*) may determine that obtained image data depicts a human object 115*a* and a human object 105.

The monitoring system control unit 110 (or monitoring application server 180 or camera such as cameras 130*a*, 130*b*, 130*c*, 130*d*, 130*e*, 130*f*, 130*g*) may determine whether each of the depicted human objects 115*a*, 105 fall within an exclusionary region 113*a-d*. In this example, the monitoring system control unit 110 (or monitoring application server 180 or camera such as cameras 130*a*, 130*b*, 130*c*, 130*d*, 130*e*, 130*f*, 130*g*) may determine that the depicted human object 115*a* falls completely within an exclusionary region 113*a* that was generated to envelope the display of a television 112 having a boundary 112*a*. The monitoring system control unit 110 (or monitoring application server 180 or camera such as cameras 130*a*, 130*b*, 130*c*, 130*d*, 130*e*, 130*f*, 130*g*) can disregard (e.g., ignore) the human object 115*a* because the human object 115*a* falls completely within the exclusionary region 113*a*. Accordingly, the monitoring system control unit 110 (or monitoring application server 180 or camera such as cameras 130*a*, 130*b*, 130*c*, 130*d*, 130*e*, 130*f*, 130*g*) will not trigger an alarm, notify the central alarm station server 190, or notify a user device 168 based on the detection of the image depicting the human object 115*a*.

The monitoring system control unit 110 (or monitoring application server 180 or camera such as cameras 130*a*, 130*b*, 130*c*, 130*d*, 130*e*, 130*f*, 130*g*) can continue to analyze the image data generated by the camera 130*g*. The monitoring system control unit 110 (or monitoring application server 180 or camera such as cameras 130*a*, 130*b*, 130*c*, 130*d*, 130*e*, 130*f*, 130*g*) detects image data depicting the human object 105 and determines that the human object 105 is not located within an exclusionary region 113*a-d*. The monitoring system control unit 110 (or monitoring application server 180 or camera such as cameras 130*a*, 130*b*, 130*c*, 130*d*, 130*e*, 130*f*, 130*g*) determines that the human object 105 represents a human object 105 that is physically present in the property 101 because the depicted human object 105 is not located within an exclusionary region 113*a-d*. Because the monitoring system control unit 110 (or monitoring application server 180 or camera such as cameras 130*a*, 130*b*, 130*c*, 130*d*, 130*e*, 130*f*, 130*g*) determines that a human object 105 is physically present in the property 101, the monitoring system control unit 110 (or monitoring application server 180 or camera such as cameras 130*a*, 130*b*, 130*c*, 130*d*, 130*e*, 130*f*, 130*g*) can trigger an alarm, notify the central alarm station server 190, notify a user device 168, or a combination thereof, based on the detection of the human object 105 that is physically present in the property 101. Accordingly, the scenario depicted in Room A results in the triggering of an alarm, transmission of a notification to the central alarm station server, transmission of a notification to a user device 168, or a combination thereof, based on the detection of the human object 105.

With reference to the example of Room B, the monitoring system control unit 110 (or monitoring application server 180 or camera such as cameras 130*a*, 130*b*, 130*c*, 130*d*, 130*e*, 130*f*, 130*g*) may obtain the image data generated by a camera 130*e* via one or more networks such as the networks 140, 170, one or more communications links 172, or a combination thereof. The monitoring system control unit 110 (or monitoring application server 180 or camera such as cameras 130*a*, 130*b*, 130*c*, 130*d*, 130*e*, 130*f*, 130*g*) may analyze the obtained image data to determine whether the image data depicts one or more human objects. With reference to the example of Room B, the monitoring system control unit 110 (or monitoring application server 180 or camera such as cameras 130*a*, 130*b*, 130*c*, 130*d*, 130*e*, 130*f*, 130*g*) may determine that obtained image data depicts a human object 115*b* and a human object 107.

In a similar manner to the example of Room A, the monitoring system control unit 110 (or monitoring application server 180 or camera such as cameras 130*a*, 130*b*, 130*c*, 130*d*, 130*e*, 130*f*, 130*g*) determines that the depicted human object 115*b* falls completely within an exclusionary region 113*b* that was generated to envelope the display of a television 114 having a boundary 114*a*. The monitoring system control unit 110 (or monitoring application server 180 or camera such as cameras 130*a*, 130*b*, 130*c*, 130*d*, 130*e*, 130*f*, 130*g*) can disregard the human object 115*b* because the human object 115*b* falls completely within the exclusionary region 113*b*. Accordingly, the monitoring system control unit 110 (or monitoring application server 180 or camera such as cameras 130*a*, 130*b*, 130*c*, 130*d*, 130*e*, 130*f*, 130*g*) will not trigger an alarm, notify the central alarm station server 190, notify a user device 168, or a combination thereof, based on a generated image depicting the human object 115*b*.

The monitoring system control unit 110 (or monitoring application server 180 or camera such as cameras 130*a*, 130*b*, 130*c*, 130*d*, 130*e*, 130*f*, 130*g*) continues to analyze the image data generated by the camera 130*e*. The monitoring system control unit 110 (or monitoring application server 180 or camera such as cameras 130*a*, 130*b*, 130*c*, 130*d*, 130*e*, 130*f*, 130*g*) detects image data depicting the human object 107. In this example, the image data depicts the human object 107 as being partially enveloped by the exclusionary region 113*b* and partially outside of the exclusionary region 113*b*. The monitoring system control unit 110 (or monitoring application server 180 or camera such as cameras 130*a*, 130*b*, 130*c*, 130*d*, 130*e*, 130*f*, 130*g*) can determine that the human object 107 represents a human object 107 that is physically present in the property 101 because at least a portion of the human object 107 is depicted outside of the exclusionary region 113*b*. Because the monitoring system control unit 110 (or monitoring application server 180 or camera such as cameras 130*a*, 130*b*, 130*c*, 130*d*, 130*e*, 130*f*, 130*g*) determines that a human person is present in the property 101, the monitoring system control unit 110 (or monitoring application server 180 or camera such as cameras 130*a*, 130*b*, 130*c*, 130*d*, 130*e*, 130*f*, 130*g*) can trigger an alarm, notify the central alarm station server 190, notify a user device 168, or a combination thereof, based on the generated image depicting the human object 107. Accordingly, the scenario depicted in Room B results in the triggering of an alarm, transmission of a notification to the central alarm station server, transmission of a notification to a user device 168, or a combination thereof, based on the detection of the human object 107 that is determined to be physically present at the property 101.

In some implementations, the monitoring system control unit 110 (or monitoring application server 180 or camera such as cameras 130*a*, 130*b*, 130*c*, 130*d*, 130*e*, 130*f*, 130*g*) may not be able to immediately determine whether the human object 107 is partially outside of the exclusionary region 113*b*. In such instances, the monitoring system control unit 110 (or monitoring application server 180 or camera such as cameras 130*a*, 130*b*, 130*c*, 130*d*, 130*e*, 130*f*, 130*g*) can analyze previously obtained image data to determine if the human object 107 has moved into or out of the exclusionary region. For example, the monitoring system control unit 110 (or monitoring application server 180 or camera such as cameras 130*a*, 130*b*, 130*c*, 130*d*, 130*e*, 130*f*, 130*g*) can rewind the image data, and analyze the re-wound image data to determine if the human object 107 has entered into the exclusionary region 113*b*. In response to determining (i) that the human object 107 has entered into the exclusionary region 113*b* from outside the exclusionary region 113*b* or (ii) that the human object 108 has exited from the exclusionary region 113*b*, then the monitoring system control unit 110 (or monitoring application server 180 or camera such as cameras 130*a*, 130*b*, 130*c*, 130*d*, 130*e*, 130*f*, 130*g*) can trigger an alarm, transmit a notification to the central alarm station server 190, transmit a notification to a user device 168, or a combination thereof.

With reference to Room C of FIG. 1, the monitoring system control unit 110 (or monitoring application server 180 or camera such as cameras 130*a*, 130*b*, 130*c*, 130*d*, 130*e*, 130*f*, 130*g*) may obtain the image data generated by a camera 130*d* via one or more networks such as the networks 140, 170, one or more communications links 172, or a combination thereof. The monitoring system control unit 110 (or monitoring application server 180 or camera such as cameras 130*a*, 130*b*, 130*c*, 130*d*, 130*e*, 130*f*, 130*g*) may analyze the obtained image data to determine whether the image data depicts one or more human objects. With reference to the example of Room C, the monitoring system control unit 110 (or monitoring application server 180 or camera such as cameras 130*a*, 130*b*, 130*c*, 130*d*, 130*e*, 130*f*, 130*g*) may determine that the obtained image data depicts a human object 115*c*.

The monitoring system control unit 110 (or monitoring application server 180 or camera such as cameras 130*a*, 130*b*, 130*c*, 130*d*, 130*e*, 130*f*, 130*g*) determines that the depicted human object 115*c* falls completely within an exclusionary region 113*c* that was generated to envelope the display of a television 116 having a boundary 116*a*. The monitoring system control unit 110 (or monitoring application server 180 or camera such as cameras 130*a*, 130*b*, 130*c*, 130*d*, 130*e*, 130*f*, 130*g*) can disregard the human object 115*c* because the human object 115*c* falls completely within the exclusionary region 113*c*. Accordingly, the monitoring system control unit 110 will not trigger an alarm, notify the central alarm station server 190, or notify a user device 168 based on an image depicting the human object 115*c* in Room C.

With reference to the example of Room D the monitoring system control unit 110 (or monitoring application server 180 or camera such as cameras 130*a*, 130*b*, 130*c*, 130*d*, 130*e*, 130*f*, 130*g*) may obtain the image data generated by a camera 130*a* or a camera 130*b* via one or more networks such as the networks 140, 170, one or more communications links 172, or a combination thereof. The monitoring system control unit 110 (or monitoring application server 180 or camera such as cameras 130*a*, 130*b*, 130*c*, 130*d*, 130*e*, 130*f*, 130*g*) may analyze the obtained image data to determine whether the image data depicts one or more human objects. With reference to the example of Room D, the monitoring system control unit 110 (or monitoring application server 180 or camera such as cameras 130*a*, 130*b*, 130*c*, 130*d*, 130*e*, 130*f*, 130*g*) may determine that the obtained image data depicts a human object 115*d* and a human object 109.

In a similar manner to the example of Room A, the monitoring system control unit 110 (or monitoring application server 180 or camera such as cameras 130*a*, 130*b*, 130*c*, 130*d*, 130*e*, 130*f*, 130*g*) determines that the depicted human object 115*d* falls completely within an exclusionary region 113*d* that was generated to envelope the display of a picture 118 having a boundary 118*a*. The monitoring system control unit 110 (or monitoring application server 180 or camera such as cameras 130*a*, 130*b*, 130*c*, 130*d*, 130*e*, 130*f*, 130*g*) can disregard the human object 115*d* because the human object 115*d* falls completely within the exclusionary region 113*d*. Accordingly, the monitoring system control unit 110 will not trigger an alarm, notify the central alarm station server 190, or notify a user device 168 based on an image depicting the human object 115*d*.

As with the examples above with reference to Rooms A, B, and C, the images depicting human object 115*d* show the depicted human object 115*d* within a framed boundary 118*a*. The human object 115*d* is not ignored because the human object 115*d* is in the boundary 118*a* of the picture frame. Instead, the human object 115*d* is ignored because the human object 115*d* is fully located within the exclusionary region 113*d*.

In other implementations, the monitoring system control unit 110 (or monitoring application server 180 or one of cameras such as cameras 130*a*, 130*b*) may obtain images of human object 115*d* generated by a plurality of cameras 130*a*, 130*b*. In some implementations, the plurality of cameras 130*a*, 130*b* may be configured as stereo cameras. In such implementations, the monitoring system control unit 110 (or monitoring application server 180 or one of cameras 130*a*, 130*b*) may be configured to receive a photo of human object 115*d* from each of the stereo cameras 130*a*, 130*b*. The photo receiving unit (e.g., monitoring system control unit 110, monitoring application server 180, or one of cameras 130*a*, 130*b*) can be configured to determine the distance from a wall and a distance of the human object 115*d* in the images using the received images. Then, if the determined distance to the human object 115*d* is the same as the determined distance to the wall, the photo receiving unit can determine that human object 115*d* is a depiction a human object 115*d* on a wall as a result of a television display, projection display, photograph, poster, or the like and not a real human person standing in the property 101.

The monitoring system control unit 110 (or monitoring application server 180 or camera such as cameras 130*a*, 130*b*, 130*c*, 130*d*, 130*e*, 130*f*, 130*g*) continues to analyze the image data generated by the camera 130*a*, 130*b*, or both. The monitoring system control unit 110 (or monitoring application server 180 or camera such as cameras 130*a*, 130*b*, 130*c*, 130*d*, 130*e*, 130*f*, 130*g*) detects image data depicting the human object 109. In this example, the image data depicts the human object 109 looking into the property 101 via a window 102. Though human object 109 is looking through a framed window 102, the monitoring system control unit 110 (or monitoring application server 180 or camera such as cameras 130*a*, 130*b*, 130*c*, 130*d*, 130*e*, 130*f*, 130*g*) determines that the human object 109 is physically present in the property 101 because the human object 109 is not located within an exclusionary region 113*a-d*. For example, images of the window 102 that include a human object 109 can be analyzed by the monitoring system control unit 110 (or monitoring application server 180 or camera such as cameras 130*a*, 130*b*, 130*c*, 130*d*, 130*e*, 130*f*, 130*g*) to determine whether they include aspects of temporal discontinuity associated with a television display, a projection screen, hologram, or the like. In such instances, the monitoring system control unit 110 (or monitoring application server 180 or camera such as cameras 130*a*, 130*b*, 130*c*, 130*d*, 130*e*, 130*f*, 130*g*) can be configured to determine between dynamically changing lighting conditions that occur in the real, physical world from the instantaneous changing of pixel values (or other colors) in a display such as a television display. Accordingly, the scenario depicted in Room D results in the triggering of an alarm, transmission of a notification to the central alarm station server 190, transmission of a notification to a user device 168, or a combination thereof.

As indicated through this disclosure, any component of a monitoring system 100 such as a monitoring system control unit 110, a monitoring application server 180, or a camera 130 may perform analysis of image data to determine whether a human object is physically present within a property 101. As an example, a camera 130*g* may capture image data of the human object 105. The camera 130*g* can analyze the obtained image data and determine whether the image data includes a human. Once the camera 130*g* determines that the image data includes a human object 105, then the camera 130*g* can determine whether the image data depicts the human object 105 in an exclusionary region. In the example of Room A, the camera 130*g* can determine that the human object 150 is not within an exclusionary region. In such instances, the camera can transmit data such as a notification to a monitoring system control unit 110 or monitoring application server 180 that, when processed by the monitoring system control unit 110 or the monitoring application server 180, causes the monitoring system control unit 110 or monitoring application server 180 to trigger an alarm event.

Alternatively, assume that the camera 130*g* can capture image data that only depicts the human object 115*a* and not any other human object. In such implementations, the camera 130*g* can determine whether the human object 115*a* resides within an exclusionary region. In this example, the camera 130*g* can determine that the human object 115*a* falls completely within the exclusionary region 113*a* and disregard (e.g., ignore) the image data. Disregarding (e.g., ignoring) the image data may include, for example, determining, by the camera 130*g* to not transmit data to the monitoring application server 180 or monitoring system control unit 110 that causes the monitoring application server 180 or monitoring system control unit 110 to trigger an alarm event.

Figure 2:
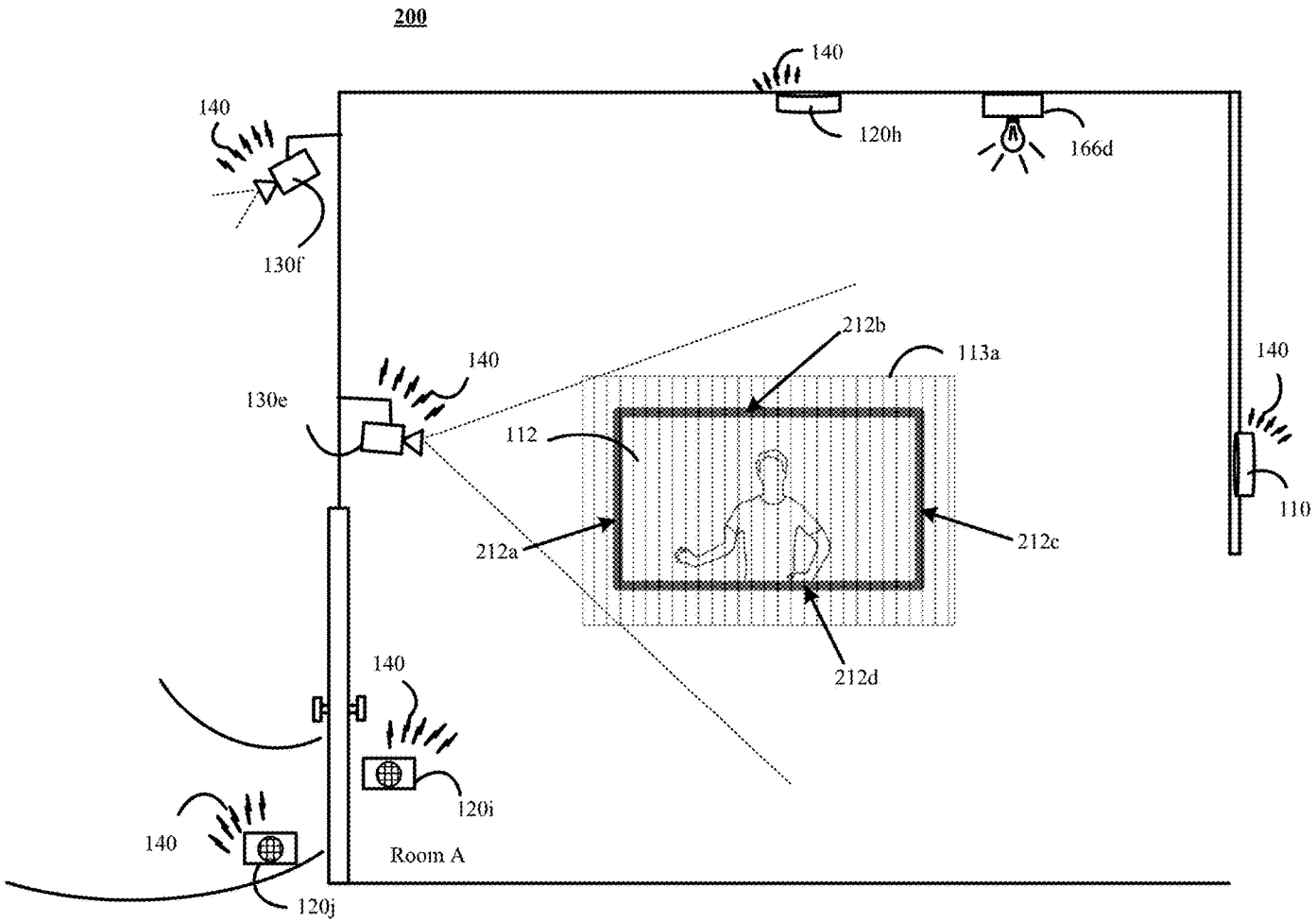
FIG. 2 is a contextual diagram of a monitoring system for detecting and generating an exclusionary region.

FIG. 2 is a contextual diagram of monitoring system 200 for detecting and generating an exclusionary region. The monitoring system 200 for detecting an exclusionary region may include, for example, a monitoring system control unit 110 (or a monitoring application server 180), a camera 130*e*, and a network 140.

A component of the monitoring 200 such as monitoring system control unit 110, monitoring application server 180, or camera 130*e* may begin the process of detecting an exclusionary region 113*a* by obtaining image data depicting portions of Room A from one or more cameras such as the camera 130*e*. The monitoring system component can analyze the obtained image data in order to determine if there are any portions of Room A that should be excluded from video surveillance. Determining if there are any portions of Room A that should be excluded from video surveillance may include, for example, scanning for displays (e.g., televisions), holograms, projections, framed pictures, posters, or any other displayed image that has the potential to create a representation of a human object that is not physically present in the property 101.

A component of the monitoring system 200 such as monitoring system control unit 110, monitoring application server 180, or camera 130*e* can analyze image data to detect displays (e.g., televisions), holograms, projections, framed pictures, posters, or the like. In some implementations, detecting displays (e.g., televisions), holograms, projections, framed pictures, posters, or the like may include identifying transitions between a first surface of a wall (or other surface) and a second surface of a display (e.g., television), framed picture, poster, or the like. For example, with reference to the television 112 of FIG. 2, a monitoring system 200 component can detect each respective boundary 212*a*, 212*b*, 212*c*, 212*d* of the television 212 by detecting a difference in the color, contrast, texture, static look, or the like in the area surrounding boundaries 212*a*, 212*b*, 212*c*, 212*d* versus the color, contrast, texture, and dynamically changing look of the display within the respective boundaries 212*a*, 212*b*, 212*c*, 212*d*. For example, the monitoring system control unit 110, monitoring application server 180, or camera 130*e* can determine between dynamically changing lighting conditions that occur on a surface such as a wall in a real, physical world from the instantaneous changing of pixel values (or other colors) in a display such as a television display.

In the same, or other implementations, a monitoring system 200 component such as monitoring system control unit 110, monitoring application server 180, or camera 130*e* may be configured to detect displays (e.g., televisions), holograms, projection screens, or the like using different techniques that are specifically geared towards identifying such display objects. For example, the monitoring system control unit 110, monitoring application server 180, or camera 130*e* may use a machine learning model trained on the appearance of screens, or the frames and items typically surrounding them (such as a laptop). In such instances, the machine learning model may be trained using labeled training data that includes an image and a label that indicates whether the images is a real, physical world image or a display object displayed by a display (e.g., television), hologram, projection screen, or the like. Such training data may include, for example, video image data representing a television display displaying a human using lighting in a manner that depicts unique characteristics of a television display and labeled as (i) display image, (ii) not a real, physical world image, or (iii) the like. Similarly, other training data items may include, for example, video image data that depicts a real human physically standing in front of a wall and labeled as (i) not a display image, (ii) a real, physical world image, or (iii) the like. Such training data items can be used to train a machine learning model such as a deep neural network to distinguish between television displays outputting video or images of a human and a real, physical world human standing in a property. Other types of training data items may also be used to train the machine learning model such as training data items showing a picture hanging on a wall and labeled as non-real world image.

In yet other implementations, a monitoring system 200 component such as monitoring system control unit 110, monitoring application server 180, or camera 130*e* may be configured to detect displays (e.g., televisions), holograms, projection screens, or the like using different techniques. For example, the monitoring system control unit 110, monitoring application server 180, or camera 130*e* can perform a shape-based analysis to determine whether a captured image includes a real world object or a display object provided for output by a display (e.g., television), hologram, projection screen, or the like. By way of example, performance of a shape-based analysis can enable a component of the monitoring system 200 such as monitoring system control unit 110, monitoring application server 180, or camera 130*e* to analyze image data to distinguish between a 2-dimensional display of a human on a television screen and a 3-dimensional shape of a real, physical world human.

In some implementations, a component of the monitoring system 200 monitoring system control unit 110, monitoring application server 180, or camera 130*e* can use a combination of multiple different analyses such as light-based analysis and shaped-based analysis. For example, a component of monitoring system 200 monitoring system control unit 110, monitoring application server 180, or camera 130*e* can perform a shape-based analysis on a hologram of a human and a real, physical world human and determine that both the hologram of the human and the real, physical world human are each 3-dimensional. However, the component of the monitoring system 200 such as monitoring system control unit 110, monitoring application server 180, or camera 130*e* can perform additional analyses such as a light-based analysis and determine that a difference in light characteristics such as flickering of lighting used to generate the hologram is different than the light that reflects off of a real, physical world human.

In yet other implementations, a component of the monitoring system 200 such as monitoring system control unit 110, monitoring application server 180, or camera 130*e* may be configured to detect displays (e.g., televisions), holograms, projection screens, or the like using different techniques. For example, a component of the monitoring system 200 such as monitoring system control unit 110, monitoring application server 180, or camera 130*e* may observe images captured of a portion of a property over a period of time. Based on this analysis, the component of the monitoring system 200 such as monitoring system control unit 110, monitoring application server 180, or camera 130*e* may determine that images of a portion of the property are, from time-to-time, associated with a rectangle (or other shape of a display) that is relatively black. The component of the monitoring system 200 such as monitoring system control unit 110, monitoring application server 180, or camera 130*e* may also determine that there are instances where the images of the portion of the property change from black to providing, for output, display objects. The component of the monitoring system 200 such as the monitoring system control unit 110, the monitoring application server 180, or the camera 130*e* may determine, based on the change of the display from off-to-on, that the portion of the property is associated with a display (e.g., a television), hologram, projection screen, or the like.

In yet other implementations, a component of the monitoring system 200 such as monitoring system control unit 110, monitoring application server 180, or camera 130*e* may be configured to detect displays (e.g., televisions), holograms, projection screens, or the like using different techniques. For example, the component of the monitoring system 200 such as monitoring system control unit 110, monitoring application server 180, or camera 130*e* may observe their dynamic range in relationship to the rest of the scene. This may include identifying object movement and determining whether the objects move beyond the ranges established by the boundaries 212*a*, 212*b*, 212*c*, 212*d* of a potential display.

The component of the monitoring system 200 such as monitoring system control unit 110, monitoring application server 180, or camera 130*e* may generate an exclusionary region 113*a* that extends to at least the respective boundaries 212*a*, 212*b*, 212*c*, 212*d* of the television 112. The exclusionary region 113*a* can establish a region of the Room A that will not be monitored for the presence of human objects that fall completely within the exclusionary region 113*a* using the image data generated by the camera 130*e*. Instead, any human object detected as falling completely within the exclusionary region 113*a* will be ignored. Data defining the location and scope of the exclusionary region 113*a* is generated by the component of the monitoring system 200 and stored by the component of the monitoring system 200 such as the monitoring system control unit 110, monitoring application server 180, or camera 130*e*.

Though aspects of the present disclosure are directed towards use of a component of the monitoring system 200 to analyze image data and determine, based on component's analysis of the image data, whether one or more locations of a property are to be designated as an exclusionary region. The present disclosure need not be so limited. For example, instead of the component of the monitoring system 200 analyzing image data, detecting an exclusionary region, generated data defining the location and scope of the exclusionary region, and storing the generated data defining the location and scope of the exclusionary region—other methods may be used. Such other methods may include, for example, a user inputting data defining a location and scope of an exclusionary region to the component of the monitoring system 200 for storage in a storage device of the component of the monitoring system 200.

The systems of FIGS. 1 and 2 are described with reference to indoor portions of a property. However, the present disclosure need not be so limited. Instead, the systems described with reference to FIGS. 1 and 2, as well as their features of their corresponding processes described above and below, can also work for outdoor portions of the property, as well.

Figure 3:
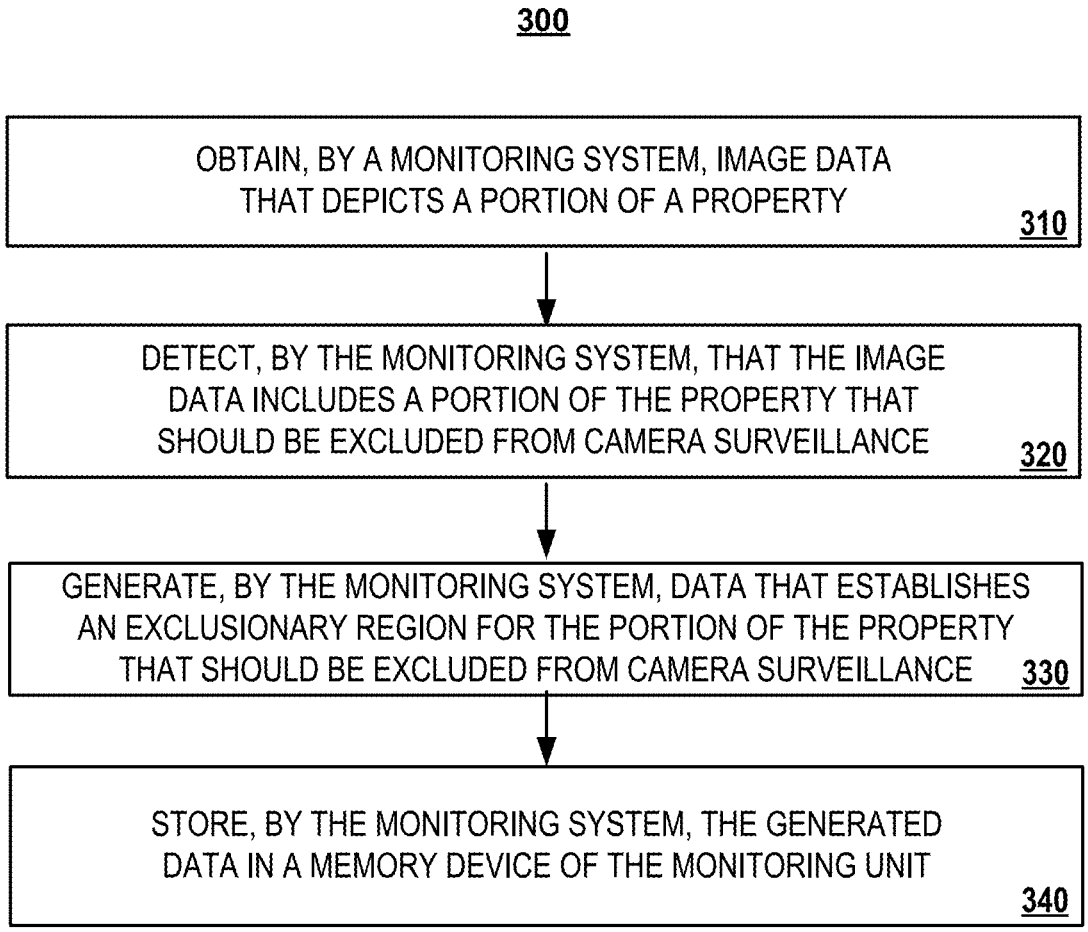
FIG. 3 is a flowchart of an example of a process for detecting an exclusionary region.

FIG. 3 is flowchart of example of a process 300 for detecting an exclusionary region. Generally, the process 300 may include, for example, obtaining, by a monitoring system, image data that depicts a portion of a property (310), detecting, by the monitoring system, that the image data includes a portion of the property that should be excluded from camera surveillance (320), generating, by the monitoring system, data that establishes an exclusionary region for the portion of the property that should be excluded from camera surveillance (330), and storing, by the monitoring system, the generated data in a memory device of the component of the monitoring system (340).

In some implementations, the process 300 for detecting an exclusionary region may be performed by a backend server component of the monitoring system such as a monitoring application server, or other server computer. In other implementations, a different component of the monitoring system such as a camera can perform the processes of detecting an exclusionary region.

Figure 4:
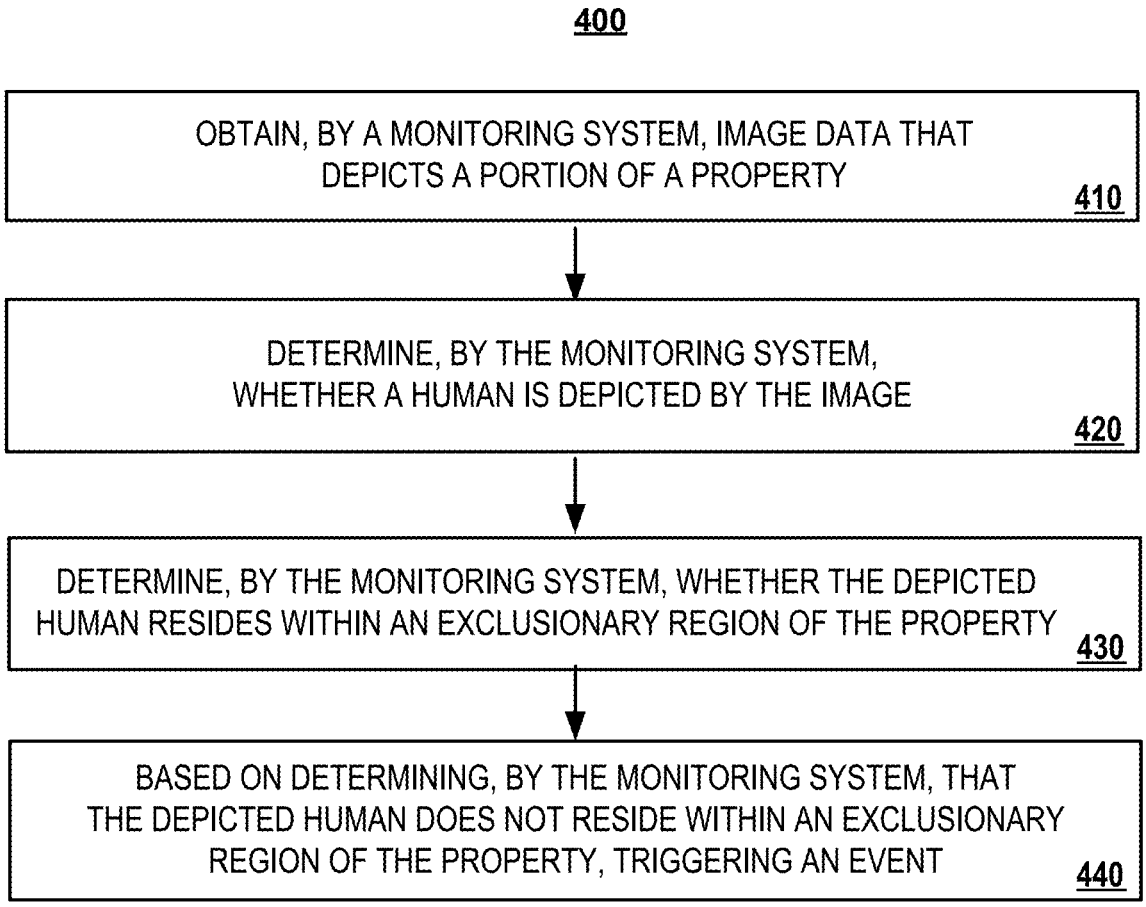
FIG. 4 is a flowchart of an example of a process for preventing false alarms due to display images.

FIG. 4 is a flowchart of an example of a process 400 for preventing false alarms due to display images. Generally, the process 400 includes obtaining, by a monitoring system, image data that depicts a portion of a property (410), determining, by the monitoring system, whether a human is depicted by the image (420), determining, by the monitoring system, whether the depicted human resides within an exclusionary region of the property (430), and based on determining, by the monitoring system, that the depicted human does not reside within an exclusionary region of the property, triggering an alarm event (440).

The features of process 400 are presented in a first particular order beginning with stage 410 and ending with stage 440. However, the present disclosure need not be so limited. For example, in some implementations, the stages of process 400 can be executed in a different order. By way of example, in some implementations, a system can perform a variation of stage 430 before stage 420. That is, the system can determine whether obtained image data include an exclusionary region, and if the obtained image data includes an exclusionary region, the system can determine whether a human object exists within the exclusionary region.

Figure 5:
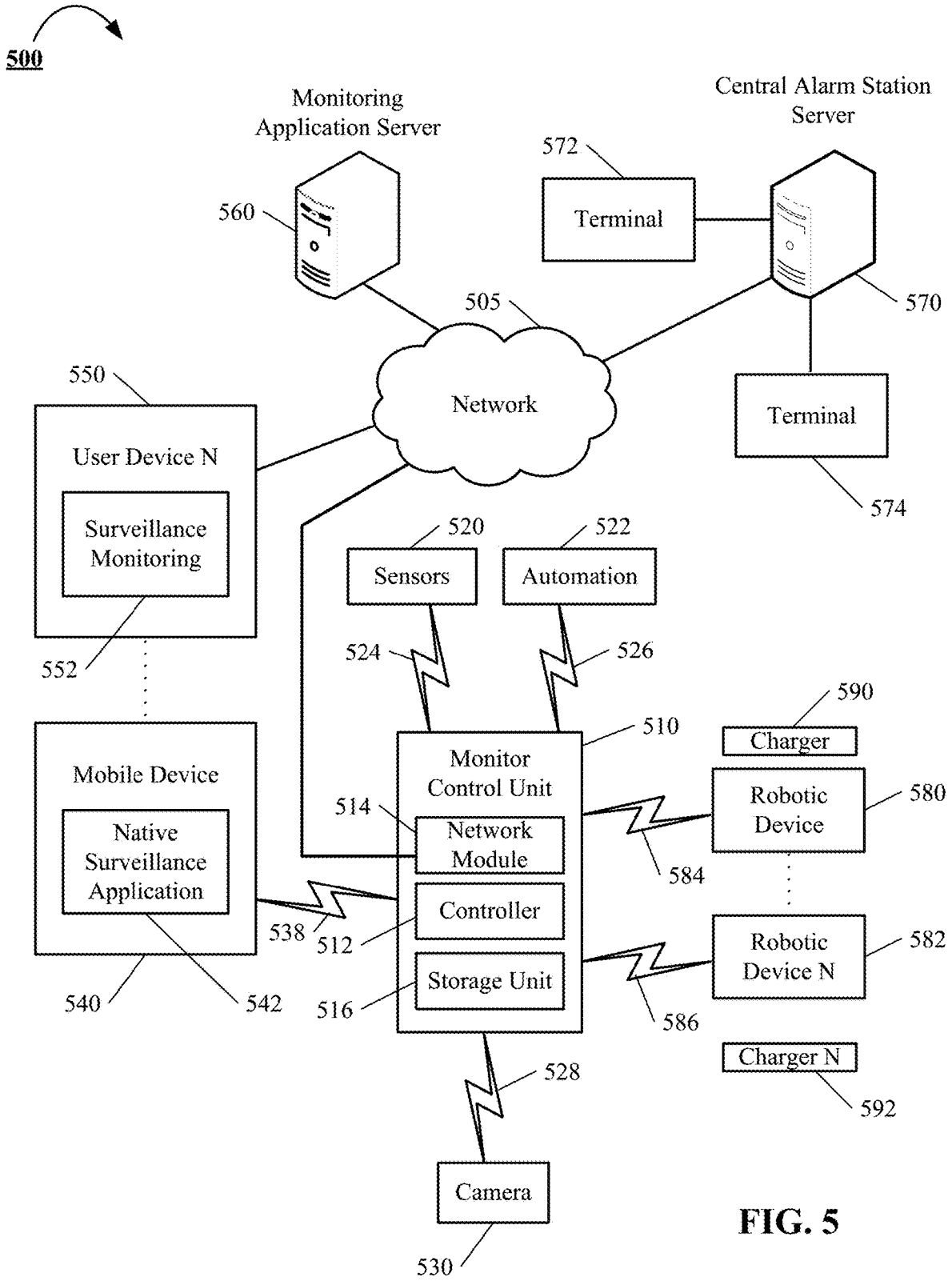
FIG. 5 is a block diagram of components that can be used to implement the monitoring systems of FIG. 1 or FIG. 2.

FIG. 5 is a block diagram of a system 500 that includes components that can be used to implement the systems of FIG. 1 or FIG. 2.

The electronic system 500 includes a network 505, a monitoring system control unit 510, one or more user devices 540, 550, a monitoring application server 560, and a central alarm station server 570. In some examples, the network 505 facilitates communications between the monitoring system control unit 510, the one or more user devices 540, 550, the monitoring application server 560, and the central alarm station server 570.

The network 505 is configured to enable exchange of electronic communications between devices connected to the network 505. For example, the network 505 may be configured to enable exchange of electronic communications between the monitoring system control unit 510, the one or more user devices 540, 550, the monitoring application server 560, and the central alarm station server 570. The network 505 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 505 may include multiple networks or subnetworks, each of which may include, for example, a wired or wireless data pathway. The network 505 may include a circuit-switched network, a packet-switched data network, or any other network able to carry electronic communications (e.g., data or voice communications). For example, the network 505 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 505 may include one or more networks that include wireless data channels and wireless voice channels. The network 505 may be a wireless network, a broadband network, or a combination of networks including a wireless network and a broadband network.

The monitoring system control unit 510 includes a controller 512, a network module 514, and storage unit 516. The controller 512 is configured to control a monitoring system (e.g., a home alarm or security system) that includes the monitoring system control unit 510. In some examples, the controller 512 may include a processor or other control circuitry configured to execute instructions of a program that controls operation of an alarm system. In these examples, the controller 512 may be configured to receive input from sensors, detectors, or other devices included in the alarm system and control operations of devices included in the alarm system or other household devices (e.g., a thermostat, an appliance, lights, etc.). For example, the controller 512 may be configured to control operation of the network module 514 included in the monitoring system control unit 510.

The monitoring system control unit 510 is configured to obtain image data generated by one or more cameras 530 and determine whether the image data depicts a human object. If a human object is detected in the image data, then the monitoring system control unit 510 is configured to determine whether an alarm should be triggered based on the image depicting a human object. A determination of whether an alarm should be triggered based on an image depicting a human object requires the monitoring system control unit 510 to determine (i) whether the human object that is depicted by one or more images actually depicts a human that is physically present in the property or (ii) whether the human object depicted by the one or more images merely depicts an image of a human displayed on a television, a projection screen (or wall), a hologram, a picture, a poster or the like.

If a depicted human object is determined, by the monitoring system control unit 510, to be a human that is physically present in the property, the monitoring system control unit 510 can be configured to trigger an alarm at the property, transmit a notification to the central alarm station server 570 indicating the detection of a potential event at the property, transmit a notification to the user device 540, 550 indicating the detection of a potential event at the property, or a combination thereof. Alternatively, if a depicted human object is determined to merely be an image of a human that is displayed on a television, a projection screen (or wall), a hologram, a picture, a poster or the like then the monitoring system control unit 510 can determine to not trigger an alarm, not transmit a notification to a central alarm station server 570, not transmit a notification to a user device 540, 550, or all of these. Because the monitoring system control unit 510 can analyze images to distinguish between human(s) that is/are physically present in the property and display images of human(s) that is/are not physically present in the property, the monitoring system control unit 510 can avoid triggering false alarms based on mere images of a human displayed on a television, a projection screen (or wall), a hologram, a picture, a poster or the like.

The monitoring system control unit 510 can generate and use exclusionary regions to determine (i) whether an image that depicts a human object depicts a human that is physically present in the property or (ii) whether an image that depicts a human object merely depicts a display of a human that is not physically present in the property. The exclusionary regions include portions of the property for which image data should be ignored. The monitoring system control unit 510 can ignore image data that is associated with an exclusionary region by, for example, disregarding any image data depicting a human object that falls completely within the exclusionary region. Accordingly, the monitoring system control unit 510 is configured to not trigger an alarm, not transmit a notification to the central alarm station server 570, or not transmit a notification to the user device 540, 550 if obtained image data depicts a human object that is completely located within an exclusionary region.

In some implementations, the monitoring system control unit 510 may store received input from sensors, detectors, user devices 540 and 550, or other devices included in system 500 may be stored in the storage unit 516. The monitoring system control unit 510 may analyze the stored input or use the network module 514 to transmit the stored input to the monitoring application server for analysis. The stored input may be analyzed by the monitoring system control unit 510 to determine whether an exclusionary region needs to be created based on the stored input. Alternatively, or in addition, the stored input may be analyzed to determine whether a human object depicted in an exclusionary region should trigger the sounding of an alarm, trigger a notification of an event to be sent to the central alarm station server 570, trigger a notification of an event to be sent to a user device 540, 550, or the like.

The network module 514 is a communication device configured to exchange communications over the network 505. The network module 514 may be a wireless communication module configured to exchange wireless communications over the network 505. For example, the network module 514 may be a wireless communication device configured to exchange communications over a wireless data channel and a wireless voice channel. In this example, the network module 514 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 514 also may be a wired communication module configured to exchange communications over the network 505 using a wired connection. For instance, the network module 514 may be a modem, a network interface card, or another type of network interface device. The network module 514 may be an Ethernet network card configured to enable the monitoring system control unit 510 to communicate over a local area network and/or the Internet. The network module 514 also may be a voiceband modem configured to enable the alarm panel to communicate over the telephone lines of Plain Old Telephone Systems (POTS).

The monitoring system that includes the monitoring system control unit 510 includes one or more sensors or detectors. For example, the monitoring system may include multiple sensors 520. The sensors 520 may include a contact sensor, a motion sensor, a glass break sensor, or any other type of sensor included in an alarm system or security system. The sensors 520 also may include an environmental sensor, such as a temperature sensor, a water sensor, a rain sensor, a wind sensor, a light sensor, a smoke detector, a carbon monoxide detector, an air quality sensor, etc. The sensors 520 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 520 may include a radio-frequency identification (RFID) sensor that identifies a particular article that includes a pre-assigned RFID tag.

The monitoring system control unit 510 communicates with the automation module 522 and the camera 530 to perform surveillance or monitoring. The automation module 522 is connected to one or more devices that enable home automation control. For instance, the automation module 522 may be connected to one or more lighting systems and may be configured to control operation of the one or more lighting systems. Also, the automation module 522 may be connected to one or more electronic locks at the property and may be configured to control operation of the one or more electronic locks (e.g., control Z-Wave locks using wireless communications in the Z-Wave protocol. Further, the automation module 522 may be connected to one or more appliances at the property and may be configured to control operation of the one or more appliances. The automation module 522 may include multiple modules that are each specific to the type of device being controlled in an automated manner. The automation module 522 may control the one or more devices based on commands received from the monitoring system control unit 510. For instance, the automation module 522 may cause a lighting system to illuminate an area to provide a better image of the area when captured by a camera 530.

The camera 530 may be a video/photographic camera or other type of optical sensing device configured to capture images. For instance, the camera 530 may be configured to capture images of an area within a building monitored by the monitoring system control unit 510. The camera 530 may be configured to capture single, static images of the area and also video images of the area in which multiple images of the area are captured at a relatively high frequency (e.g., thirty images per second). The camera 530 may be controlled based on commands received from the monitoring system control unit 510.

The camera 530 may be triggered by several different types of techniques. For instance, a Passive Infra Red (PIR) motion sensor may be built into the camera 530 and used to trigger the camera 530 to capture one or more images when motion is detected. The camera 530 also may include a microwave motion sensor built into the camera and used to trigger the camera 530 to capture one or more images when motion is detected. The camera 530 may have a "normally open" or "normally closed" digital input that can trigger capture of one or more images when external sensors (e.g., the sensors 520, PIR, door/window, etc.) detect motion or other events. In some implementations, the camera 530 receives a command to capture an image when external devices detect motion or another potential alarm event. The camera 530 may receive the command from the controller 512 or directly from one of the sensors 520.

In some examples, the camera 530 triggers integrated or external illuminators (e.g., Infra Red, Z-wave controlled "white" lights, lights controlled by the module 522, etc.) to improve image quality when the scene is dark. An integrated or separate light sensor may be used to determine if illumination is desired and may result in increased image quality.

The camera 530 may be programmed with any combination of time/day schedules, system "arming state", or other variables to determine whether images should be captured or not when triggers occur. The camera 530 may enter a low-power mode when not capturing images. In this case, the camera 530 may wake periodically to check for inbound messages from the controller 512. The camera 530 may be powered by internal, replaceable batteries if located remotely from the monitoring control unit 510. The camera 530 may employ a small solar cell to recharge the battery when light is available. Alternatively, the camera 530 may be powered by the controller's 512 power supply if the camera 530 is co-located with the controller 512.

In some implementations, the camera 530 communicates directly with the monitoring application server 560 over the Internet. In these implementations, image data captured by the camera 530 does not pass through the monitoring system control unit 510 and the camera 530 receives commands related to operation from the monitoring application server 560.

The system 500 further includes one or more robotic devices 580 and 582. The robotic devices 580 and 582 may be any type of robots that are capable of moving and taking actions that assist monitoring user behavior patterns. For example, the robotic devices 580 and 582 may include drones that are capable of moving throughout a property based on automated control technology and/or user input control provided by a user. In this example, the drones may be able to fly, roll, walk, or otherwise move about the property. The drones may include helicopter type devices (e.g., quad copters), rolling helicopter type devices (e.g., roller copter devices that can fly and also roll along the ground, walls, or ceiling) and land vehicle type devices (e.g., automated cars that drive around a property). In some cases, the robotic devices 580 and 582 may be robotic devices that are intended for other purposes and merely associated with the monitoring system 500 for use in appropriate circumstances. For instance, a robotic vacuum cleaner device may be associated with the monitoring system 500 as one of the robotic devices 580 and 582 and may be controlled to take action responsive to monitoring system events.

In some examples, the robotic devices 580 and 582 automatically navigate within a property. In these examples, the robotic devices 580 and 582 include sensors and control processors that guide movement of the robotic devices 580 and 582 within the property. For instance, the robotic devices 580 and 582 may navigate within the property using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 580 and 582 may include control processors that process output from the various sensors and control the robotic devices 580 and 582 to move along a path that reaches the desired destination and avoids obstacles. In this regard, the control processors detect walls or other obstacles in the property and guide movement of the robotic devices 580 and 582 in a manner that avoids the walls and other obstacles.

In addition, the robotic devices 580 and 582 may store data that describes attributes of the property. For instance, the robotic devices 580 and 582 may store a floorplan and/or a three-dimensional model of the property that enables the robotic devices 580 and 582 to navigate the property. During initial configuration, the robotic devices 580 and 582 may receive the data describing attributes of the property, determine a frame of reference to the data (e.g., a home or reference location in the property), and navigate the property based on the frame of reference and the data describing attributes of the property. Further, initial configuration of the robotic devices 580 and 582 also may include learning of one or more navigation patterns in which a user provides input to control the robotic devices 580 and 582 to perform a specific navigation action (e.g., fly to an upstairs bedroom and spin around while capturing video and then return to a home charging base). In this regard, the robotic devices 580 and 582 may learn and store the navigation patterns such that the robotic devices 580 and 582 may automatically repeat the specific navigation actions upon a later request.

In addition to navigation patterns that are learned during initial configuration, the robotic devices 580 and 582 may also be configured to learn additional navigational patterns. For instance, a robotic device 580 and 582 can be programmed to travel along particular navigational paths in response to an instruction from the monitoring system control unit 510 to investigate a portion of the property associated with a sensor that broadcasted data that, when processed by the monitoring system control unit 510, indicates the existence of an event.

In some examples, the robotic devices 580 and 582 may include data capture and recording devices. In these examples, the robotic devices 580 and 582 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the property and users in the property. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 580 and 582 to take and store a biometric sample that can be used to identify the person (e.g., a biometric sample with DNA that can be used for DNA testing).

In some implementations, the robotic devices 580 and 582 may include output devices. In these implementations, the robotic devices 580 and 582 may include one or more displays, one or more speakers, one or more projectors, and/or any type of output devices that allow the robotic devices 580 and 582 to communicate information to a nearby user. The one or more projectors may include projectors that project a two-dimensional image onto a surface (e.g., wall, floor, or ceiling) and/or holographic projectors that project three-dimensional holograms into a nearby space.

The robotic devices 580 and 582 also may include a communication module that enables the robotic devices 580 and 582 to communicate with the monitoring system control unit 510, each other, and/or other devices. The communication module may be a wireless communication module that allows the robotic devices 580 and 582 to communicate wirelessly. For instance, the communication module may be a Wi-Fi module that enables the robotic devices 580 and 582 to communicate over a local wireless network at the property. The communication module further may be a 900 MHz wireless communication module that enables the robotic devices 580 and 582 to communicate directly with the monitoring system control unit 510. Other types of short-range wireless communication protocols, such as Bluetooth, Bluetooth LE, Z-wave, ZigBee, etc., may be used to allow the robotic devices 580 and 582 to communicate with other devices in the property.

The robotic devices 580 and 582 further may include processor and storage capabilities. The robotic devices 580 and 582 may include any suitable processing devices that enable the robotic devices 580 and 582 to operate applications and perform the actions described throughout this disclosure. In addition, the robotic devices 580 and 582 may include solid state electronic storage that enables the robotic devices 580 and 582 to store applications, configuration data, collected sensor data, and/or any other type of information available to the robotic devices 580 and 582.

The robotic devices 580 and 582 are associated with one or more charging stations 590 and 592. The charging stations 590 and 592 may be located at predefined home base or reference locations in the property. The robotic devices 580 and 582 may be configured to navigate to the charging stations 590 and 592 after completion of tasks needed to be performed for the monitoring system 500. For instance, after completion of a monitoring operation or upon instruction by the monitoring system control unit 510, the robotic devices 580 and 582 may be configured to automatically fly to and land on one of the charging stations 590 and 592. In this regard, the robotic devices 580 and 582 may automatically maintain a fully charged battery in a state in which the robotic devices 580 and 582 are ready for use by the monitoring system 500.

The charging stations 590 and 592 may be contact based charging stations and/or wireless charging stations. For contact based charging stations, the robotic devices 580 and 582 may have readily accessible points of contact that the robotic devices 580 and 582 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 580 and 582 may charge through a wireless exchange of power. In these cases, the robotic devices 580 and 582 need only locate themselves closely enough to the wireless charging stations for the wireless exchange of power to occur. In this regard, the positioning needed to land at a predefined home base or reference location in the property may be less precise than with a contact based charging station. Based on the robotic devices 580 and 582 landing at a wireless charging station, the wireless charging station outputs a wireless signal that the robotic devices 580 and 582 receive and convert to a power signal that charges a battery maintained on the robotic devices 580 and 582.

The sensors 520, the module 522, the camera 530, and the robotic devices 580 and 582 communicate with the controller 512 over communication links 524, 526, 528, 532, 584, and 586. The communication links 524, 526, 528, 532, 584, and 586 may be a wired or wireless data pathway configured to transmit signals from the sensors 520, the module 522, the camera 530, and the robotic devices 580 and 582 to the controller 512. The sensors 520, the module 522, the camera 530, and the robotic devices 580 and 582 may continuously transmit sensed values to the controller 512, periodically transmit sensed values to the controller 512, or transmit sensed values to the controller 512 in response to a change in a sensed value.

The communication links 524, 526, 528, 532, 584, and 586 may include a local network. The sensors 520, the module 522, the camera 530, and the robotic devices 580 and 582 and the controller 512 may exchange data and commands over the local network. The local network may include 802.11 "Wi-Fi" wireless Ethernet (e.g., using low-power Wi-Fi chipsets), Z-Wave, ZigBee, Bluetooth, "Homeplug" or other "Powerline" networks that operate over AC wiring, and a Category 5 (CATS) or Category 6 (CAT6) wired Ethernet network. The local network may be a mesh network constructed based on the devices connected to the mesh network.

The monitoring application server 560 is an electronic device configured to provide monitoring services by exchanging electronic communications with the monitoring system control unit 510, the one or more user devices 540, 550, and the central alarm station server 570 over the network 505. For example, the monitoring application server 560 may be configured to monitor events (e.g., alarm events) generated by the monitoring system control unit 510. In this example, the monitoring application server 560 may exchange electronic communications with the network module 514 included in the monitoring system control unit 510 to receive information regarding events (e.g., alarm events) detected by the monitoring system control unit 510. The monitoring application server 560 also may receive information regarding events (e.g., alarm events) from the one or more user devices 540, 550.

In some examples, the monitoring application server 560 may route alarm data received from the network module 514 or the one or more user devices 540, 550 to the central alarm station server 570. For example, the monitoring application server 260 may transmit the alarm data to the central alarm station server 570 over the network 505.

The monitoring application server 560 may store sensor and image data received from the monitoring system and perform analysis of sensor and image data received from the monitoring system. Based on the analysis, the monitoring application server 560 may communicate with and control aspects of the monitoring system control unit 510 or the one or more user devices 540, 550.

The central alarm station server 570 is an electronic device configured to provide alarm monitoring service by exchanging communications with the monitoring system control unit 510, the one or more mobile devices 540, 550, and the monitoring application server 560 over the network 505. For example, the central alarm station server 570 may be configured to monitor alarm events generated by the monitoring system control unit 510. In this example, the central alarm station server 570 may exchange communications with the network module 514 included in the monitoring system control unit 510 to receive information regarding alarm events detected by the monitoring system control unit 510. The central alarm station server 570 also may receive information regarding alarm events from the one or more mobile devices 540, 550 and/or the monitoring application server 560.

The central alarm station server 570 is connected to multiple terminals 572 and 574. The terminals 572 and 574 may be used by operators to process alarm events. For example, the central alarm station server 570 may route alarm data to the terminals 572 and 574 to enable an operator to process the alarm data. The terminals 572 and 574 may include general-purpose computers (e.g., desktop personal computers, workstations, or laptop computers) that are configured to receive alarm data from a server in the central alarm station server 570 and render a display of information based on the alarm data. For instance, the controller 512 may control the network module 514 to transmit, to the central alarm station server 570, alarm data indicating that a sensor 520 detected a door opening when the monitoring system was armed. The central alarm station server 570 may receive the alarm data and route the alarm data to the terminal 572 for processing by an operator associated with the terminal 572. The terminal 572 may render a display to the operator that includes information associated with the alarm event (e.g., the name of the user of the alarm system, the address of the building the alarm system is monitoring, the type of alarm event, etc.) and the operator may handle the alarm event based on the displayed information.

In some implementations, the terminals 572 and 574 may be mobile devices or devices designed for a specific function. Although FIG. 5 illustrates two terminals for brevity, actual implementations may include more (and, perhaps, many more) terminals.

The one or more user devices 540, 550 are devices that host and display user interfaces. For instance, the user device 540 is a mobile device that hosts one or more native applications (e.g., the native surveillance application 542). The user device 540 may be a cellular phone or a non-cellular locally networked device with a display. The user device 540 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 540 may perform functions unrelated to the monitoring system, such as placing personal telephone calls, playing music, playing video, displaying pictures, browsing the Internet, maintaining an electronic calendar, etc.

The user device 540 includes a native surveillance application 542. The native surveillance application 542 refers to a software/firmware program running on the corresponding mobile device that enables the user interface and features described throughout. The user device 540 may load or install the native surveillance application 542 based on data received over a network or data received from local media. The native surveillance application 542 runs on mobile devices platforms, such as iPhone, iPod touch, Blackberry, Google Android, Windows Mobile, etc. The native surveillance application 542 enables the user device 540 to receive and process image and sensor data from the monitoring system.

The user device 550 may be a general-purpose computer (e.g., a desktop personal computer, a workstation, or a laptop computer) that is configured to communicate with the monitoring application server 560 and/or the monitoring system control unit 510 over the network 505. The user device 550 may be configured to display a surveillance monitoring user interface 552 that is generated by the user device 550 or generated by the monitoring application server 560. For example, the user device 550 may be configured to display a user interface (e.g., a web page) provided by the monitoring application server 560 that enables a user to perceive images captured by the camera 530 and/or reports related to the monitoring system. Although FIG. 5 illustrates two user devices for brevity, actual implementations may include more (and, perhaps, many more) or fewer user devices.

In some implementations, the one or more user devices 540, 550 communicate with and receive monitoring system data from the monitoring system control unit 510 using the communication link 538. For instance, the one or more user devices 540, 550 may communicate with the monitoring system control unit 510 using various local wireless protocols such as Wi-Fi, Bluetooth, Z-wave, ZigBee, HomePlug (Ethernet over powerline), or wired protocols such as Ethernet and USB, to connect the one or more user devices 540, 550 to local security and automation equipment. The one or more user devices 540, 550 may connect locally to the monitoring system and its sensors and other devices. The local connection may improve the speed of status and control communications because communicating through the network 505 with a remote server (e.g., the monitoring application server 560) may be significantly slower.

Although the one or more user devices 540, 550 are shown as communicating with the monitoring system control unit 510, the one or more user devices 540, 550 may communicate directly with the sensors and other devices controlled by the monitoring system control unit 510. In some implementations, the one or more user devices 540, 550 replace the monitoring system control unit 510 and perform the functions of the monitoring system control unit 510 for local monitoring and long range/offsite communication.

In other implementations, the one or more user devices 540, 550 receive monitoring system data captured by the monitoring system control unit 510 through the network 505. The one or more user devices 540, 550 may receive the data from the monitoring system control unit 510 through the network 505 or the monitoring application server 560 may relay data received from the monitoring system control unit 510 to the one or more user devices 540, 550 through the network 505. In this regard, the monitoring application server 560 may facilitate communication between the one or more user devices 540, 550 and the monitoring system.

In some implementations, the one or more user devices 540, 550 may be configured to switch whether the one or more user devices 540, 550 communicate with the monitoring system control unit 510 directly (e.g., through link 538) or through the monitoring application server 560 (e.g., through network 505) based on a location of the one or more user devices 540, 550. For instance, when the one or more user devices 540, 550 are located close to the monitoring system control unit 510 and in range to communicate directly with the monitoring system control unit 510, the one or more user devices 540, 550 use direct communication. When the one or more user devices 540, 550 are located far from the monitoring system control unit 510 and not in range to communicate directly with the monitoring system control unit 510, the one or more user devices 540, 550 use communication through the monitoring application server 560.

Although the one or more user devices 540, 550 are shown as being connected to the network 505, in some implementations, the one or more user devices 540, 550 are not connected to the network 505. In these implementations, the one or more user devices 540, 550 communicate directly with one or more of the monitoring system components and no network (e.g., Internet) connection or reliance on remote servers is needed.

In some implementations, the one or more user devices 540, 550 are used in conjunction with only local sensors and/or local devices in a house. In these implementations, the system 500 only includes the one or more user devices 540, 550, the sensors 520, the module 522, the camera 530, and the robotic devices 580 and 582. The one or more user devices 540, 550 receive data directly from the sensors 520, the module 522, the camera 530, and the robotic devices 580 and 582 and sends data directly to the sensors 520, the module 522, the camera 530, and the robotic devices 580 and 582. The one or more user devices 540, 550 provide the appropriate interfaces/processing to provide visual surveillance and reporting.

In other implementations, the system 500 further includes network 505 and the sensors 520, the module 522, the camera 530, and the robotic devices 580 and 582 are configured to communicate sensor and image data to the one or more user devices 540, 550 over network 505 (e.g., the Internet, cellular network, etc.). In yet another implementation, the sensors 520, the module 522, the camera 530, and the robotic devices 580 and 582 (or a component, such as a bridge/router) are intelligent enough to change the communication pathway from a direct local pathway when the one or more user devices 540, 550 are in close physical proximity to the sensors 520, the module 522, the camera 530, and the robotic devices 580 and 582 to a pathway over network 505 when the one or more user devices 540, 550 are farther from the sensors 520, the module 522, the camera 530, and the robotic devices 580 and 582. In some examples, the system leverages GPS information from the one or more user devices 540, 550 to determine whether the one or more user devices 540, 550 are close enough to the sensors 520, the module 522, the camera 530, and the robotic devices 580 and 582 to use the direct local pathway or whether the one or more user devices 540, 550 are far enough from the sensors 520, the module 522, the camera 530, and the robotic devices 580 and 582 that the pathway over network 505 is required. In other examples, the system leverages status communications (e.g., pinging) between the one or more user devices 540, 550 and the sensors 520, the module 522, the camera 530, and the robotic devices 580 and 582 to determine whether communication using the direct local pathway is possible. If communication using the direct local pathway is possible, the one or more user devices 540, 550 communicate with the sensors 520, the module 522, the camera 530, and the robotic devices 580 and 582 using the direct local pathway. If communication using the direct local pathway is not possible, the one or more user devices 540, 550 communicate with the sensors 520, the module 522, the camera 530, and the robotic devices 580 and 582 using the pathway over network 505.

In some implementations, the system 500 provides end users with access to images captured by the camera 530 to aid in decision making. The system 500 may transmit the images captured by the camera 530 over a wireless WAN network to the user devices 540, 550. Because transmission over a wireless WAN network may be relatively expensive, the system 500 uses several techniques to reduce costs while providing access to significant levels of useful visual information.

In some implementations, a state of the monitoring system and other events sensed by the monitoring system may be used to enable/disable video/image recording devices (e.g., the camera 530). In these implementations, the camera 530 may be set to capture images on a periodic basis when the alarm system is armed in an "Away" state, but set not to capture images when the alarm system is armed in a "Stay" state or disarmed. In addition, the camera 530 may be triggered to begin capturing images when the alarm system detects an event, such as an alarm event, a door opening event for a door that leads to an area within a field of view of the camera 530, or motion in the area within the field of view of the camera 530. In other implementations, the camera 530 may capture images continuously, but the captured images may be stored or transmitted over a network when needed.

What is claimed is:

1. A monitoring system for monitoring a property, comprising:

one or more processors and one or more storage devices storing instructions that, when executed by the one or more processors, cause the one or more processors to perform operations comprising:

determining, in a first image depicting a portion of the property at a first time, that a depiction of an object is located entirely within boundaries of an exclusionary region;

obtaining a second image depicting the portion of the property at a second time;

based on determining, in the first image, that the depiction of the object is located entirely within the boundaries of the exclusionary region, determining, whether a depiction of the object in the second image is located entirely within the boundaries of the exclusionary region;

based on determining that any portion of the depiction of the object in the second image is located outside of the boundaries of the exclusionary region, determining that the object is moving about the portion of the property; and based on determining that the object is moving about the portion of the property, performing a monitoring system action.

2. The monitoring system of claim 1, wherein the monitoring system action would not be performed were the object determined not to be moving about the portion of the property.

3. The monitoring system of claim 1, wherein determining that the object is moving about the portion of the property comprises determining that, between the second time and the first time, the depiction of the object moved into the exclusionary region from outside the exclusionary region.

4. The monitoring system of claim 1, wherein the second time is after the first time.

5. The monitoring system of claim 1, wherein determining that the object is moving about the portion of the property comprises determining that, between the first time and the second time, the depiction of the object moved out of the exclusionary region from inside the exclusionary region.

6. The monitoring system of claim 1, wherein data identifying the exclusionary region was generated by the monitoring system based on an identification, by the monitoring system, that a portion of a different image depicts a picture on a wall, a display of a television, or a window.

7. The monitoring system of claim 6, wherein the boundaries of the exclusionary region are determined, by the monitoring system, based on a transition of first visual characteristics of portions of a wall that surround each respective side of the picture of the object on the wall, the display of the television, or the window to second visual characteristics of respective edges of the picture on the wall, the display of the television, or the window.

8. The monitoring system of claim 1, wherein the exclusionary region comprises a two-dimensional area within a field of view of a camera, wherein the boundaries envelope a picture on a wall, a display of a television, or a window.

9. The monitoring system of claim 1, wherein the first image and the second image each include a still camera image or a video image frame.

10. The monitoring system of claim 1, wherein the first image and the second image are each captured by a camera at the property.

11. The monitoring system of claim 1, wherein the object includes a human, a human with a package, an animal, or a vehicle.

12. The monitoring system of claim 1, wherein the monitoring system action includes one or more of activating an alarm, transmitting a notification to a user device, powering on one or more connected lightbulbs located at the property, or recording sounds at the property using one or more microphones located at the property.

13. A method comprising:

determining, by a monitoring system monitoring a property and in a first image depicting a portion of the property at a first time, that a depiction of an object is located entirely within boundaries of an exclusionary region;

obtaining a second image depicting the portion of the property at a second time;

based on determining, in the first image, that the depiction of the object is located entirely within the boundaries of the exclusionary region, determining whether a depiction of the object in the second image is located entirely within the boundaries of the exclusionary region;

based on determining that any portion of the depiction of the object in the second image is located outside of the boundaries of the exclusionary region, determining that the object is moving about the portion of the property; and based on determining that the object is moving about the portion of the property, performing a monitoring system action.

14. The method of claim 13, wherein the monitoring system action would not be performed were the object determined not to be moving about the portion of the property.

15. The method of claim 13, wherein determining that the object is moving about the portion of the property comprises determining that, between the second time and the first time, the depiction of the object moved into the exclusionary region from outside the exclusionary region.

16. The method of claim 13, wherein determining that the object is moving about the portion of the property comprises determining that, between the first time and the second time, the depiction of the object moved out of the exclusionary region from inside the exclusionary region.

17. A non-transitory computer-readable medium storing software comprising instructions executable by one or more computers which, upon such execution, cause the one or more computers to perform operations comprising:

determining, by a monitoring system monitoring a property and in a first image depicting a portion of the property at a first time, that a depiction of an object is located entirely within boundaries of an exclusionary region;

obtaining a second image depicting the portion of the property at a second time;

based on determining, in the first image, that the depiction of the object is located entirely within the boundaries of the exclusionary region, determining whether a depiction of the object in the second image is located entirely within the boundaries of the exclusionary region;

based on determining that any portion of the depiction of the object in the second image is located outside of the boundaries of the exclusionary region, determining that the object is moving about the portion of the property; and based on determining that the object is moving about the portion of the property, performing a monitoring system action.

18. The monitoring system of claim 1, wherein determining that the depiction of the object is located entirely within the boundaries of the exclusionary region comprises determining that no portion of the object crosses any of the boundaries of the exclusionary region.

19. The monitoring system of claim 1, wherein determining that the depiction of the object is located entirely within the boundaries of the exclusionary region comprises determining that all portions of the object are enveloped by the boundaries of the exclusionary region.

20. The monitoring system of claim 1, the operations comprising:

based on determining that any portion of the depiction of the object in the second image is located outside of the boundaries of the exclusionary region, determining that the object is physically present at the property.

* * * * *